US005353437A

United States Patent [19]

Field et al.

[11] Patent Number: 5,353,437

[45] Date of Patent: Oct. 11, 1994

[54] COMBINATION HELMET AND BODY PROTECTION DEVICE

[75] Inventors: Michael R. Field; Gregory D. Caldwell, both of Glenview, Ill.

[73] Assignee: Protec Field Gear, Inc., Des Plaines, Ill.

[21] Appl. No.: 66,712

[22] Filed: May 24, 1993

[51] Int. Cl.[5] ..... A41D 13/00; A42B 1/00

[52] U.S. Cl. ..... 2/2; 2/421; 2/425

[58] Field of Search ..... 2/2, 410, 425, 424, 2/415, 414, 421, 422, 411, 44, 45

[56] References Cited

U.S. PATENT DOCUMENTS

| | | | |
|---|---|---|---|
| 1,276,200 | 8/1918 | Flanagan . | |
| 2,939,148 | 6/1960 | Hart et al. . | |
| 3,134,106 | 5/1964 | Shaffer et al. . | |
| 3,148,375 | 9/1964 | Jones . | |
| 3,242,500 | 3/1966 | Deer . | |
| 3,286,275 | 11/1966 | Marchello . | |
| 3,293,659 | 12/1966 | Shepard . | |
| 3,373,443 | 3/1968 | Marietta . | |
| 3,522,804 | 8/1970 | Towbin . | |
| 3,671,974 | 6/1972 | Sims . | |
| 3,707,004 | 12/1972 | Kapitan et al. . | |
| 3,818,509 | 6/1974 | Romo et al. . | |
| 3,879,761 | 4/1975 | Bothwell | 2/415 |
| 3,900,896 | 8/1975 | Ackerman . | |
| 3,978,525 | 9/1976 | Bothwell | 2/424 |
| 3,991,421 | 11/1976 | Stratten | 2/2 |
| 4,021,858 | 5/1977 | Neeld et al. . | |
| 4,031,564 | 6/1977 | Wood . | |
| 4,173,795 | 11/1979 | Lundin et al. . | |
| 4,317,237 | 3/1982 | Porte | 2/2 |
| 4,602,385 | 7/1986 | Warren . | |
| 4,825,476 | 5/1989 | Andrews . | |
| 4,999,855 | 3/1991 | Brown . | |
| 5,029,341 | 7/1991 | Wingo, Jr. | 2/2 |
| 5,123,408 | 6/1992 | Gaines . | |
| 5,295,271 | 3/1994 | Butterfield et al. | 2/424 |

FOREIGN PATENT DOCUMENTS

| | | | |
|---|---|---|---|
| 1727780 | 4/1992 | U.S.S.R. | 2/421 |

*Primary Examiner*—Clifford D. Crowder
*Assistant Examiner*—Michael A. Neas
*Attorney, Agent, or Firm*—Robert E. Browne; Thomas C. McDonough

[57] ABSTRACT

A combination helmet and body protection device for use in sports such as American football and other hazardous activities such as driving, cycling, hockey, riot control, and fire fighting to protect the human body from potentially crippling forces applied to the head and upper body, comprising an upper torso section having internal padding attached thereto, an outer helmet which can be securely connected to the upper torso section so that the outer helmet cannot rotate with respect thereto and which can be easily removed from the upper torso section, and an inner helmet section which fits securely on the wearer's head and which allows rotation of the wearer's head inside the outer helmet section.

10 Claims, 9 Drawing Sheets

COMBINATION HELMET AND BODY PROTECTION DEVICE

BACKGROUND OF THE INVENTION

This invention relates to a combination helmet and body protection device useful for the sports of American football, lacrosse, and other sports or activities where contact with other participants and/or objects may occur. It is well known that many sports and occupations present a high degree of risk to the participants. One of the key areas of risk is in trauma to the cervical spine, which often result in injury to the participant's spinal cord, the bony structure of the spine, disks and connective tissue, and result in some level of disability and/or death.

A large number of these injuries result from axial loading, i.e., a high load being placed on the top of the participant's head, as during tackling or blocking in American football. For example, since at least the mid-1970's football players at all levels have been taught to keep their heads up during tackling and blocking, and not to use their head as a "battering ram." Use of the shoulders during these activities reduces the chances that the player will suffer a catastrophic spinal cord injury during blocking or tackling. However, such injuries do still occur at alarming numbers due to a number of possible reasons. For example, it is often reflexive for a player to lower his head during a tackle. In addition, "freak accidents" have occurred at all levels of sport. Improper coaching techniques and equipment which is not designed to offer protection to the participant from such injuries can contribute to these problems, particularly at the lower age levels. In addition, catastrophic cervical spine injuries can occur from contact with the ground during a fall or from other contact that, due to the nature of the sport or activity, cannot be predicted or controlled.

Using American football as an example, currently available equipment is very similar in overall design. The equipment available to the professional is better in many respects to that available to other levels but these differences are often in the materials with which the products are made, and not in the actual design of such devices.

The currently available protective equipment for the upper body generally includes a helmet and shoulder protection, and, for some, neck braces and rib protectors. When an individual is equipped with the standard helmet and shoulder pads currently available, the force of a blow to the top of the head is transmitted solely through the participant's neck, thus resulting in a high axial or lateral load on the cervical spine and exposing the wearer's neck or spine to potentially crippling forces.

A further problem which is also likely to result in serious damage to the participant's neck is whiplash resulting from a quick and violent wrenching of the head in one direction due to, among other things, the player's face mask being grabbed and pulled from the side or the head being forced violently to the front or back.

There have been other attempts made to create football equipment which eliminates or reduces the above-described problems. However, none of these prior attempts have been ultimately successful, as is demonstrated by the fact that catastrophic cervical spine injuries are still occurring at alarming rates at all levels of sport. See, e.g., Cantu and Mueller, *Catastrophic Spine Injuries in Football* (1977–1989), Journal of Spine Disorders (vol. 3, no. 3, 1990).

One of the main reasons that prior attempts to reduce spine injuries have failed is due to the nature of the sport itself. Football, for example, is a fast and violent sport which requires great athletic ability and flexibility. Many prior art devices are either cumbersome and would not be practical in regular usage, or would excessively and unacceptably limit the flexibility and/or visibility of the players; thus making many of these devices difficult for the players to use.

These same problems exist when attempting to provide sufficient protection in other activities such as driving, cycling, riot control, fire fighting, etc.

SUMMARY OF THE INVENTION

It is an object of this invention to create a head and body protection unit for use during football and similar sports, which will protect the head, neck, spine and upper body of the player, while still maintaining a high level of flexibility. This equipment should also be adaptable to meet the different needs of different players. For example, quarterbacks and wide receivers require much greater flexibility and visibility than do linemen. It is a further object of this invention to provide football equipment that protects a player from cervical spine injuries due to axial loading from blows on top of the head by transferring the force of the blow to the player's shoulders and upper body.

It is a further object of this invention to allow the use of a combination helmet and upper body protector which prevents the player's neck from being wrenched violently to one side, while still allowing a full range of both direct and peripheral visibility.

The above objects are satisfied by the use of a combination helmet and body protection device which comprises a semi-rigid shock resistant structure which protects the head, neck, shoulders, chest and lower torso of the player. Any external forces directed to the head, neck and shoulder area are transferred to the musculature of the upper chest and back.

The present invention consists of three major sections, a helmet, an inner helmet, and an upper torso section which includes attached padding that may extend down to the waist. All of the sections except the inner helmet are connected to form a single unit. It is recommended that the gear be made from a high impact plastic material.

The invention requires an inner helmet to be worn with a chin strap. The outer surface of the inner helmet conforms to the inner surface of the high impact outer helmet. This inner helmet should be constructed of high shock absorbent material that can be sized to accommodate various head sizes. The outer surface of the headgear will conform to the inner surface of the outer helmet to allow for free movement of the head with an adequate air space.

This inner helmet will be fabricated from foam type material that compresses under pressure and returns to original shape when pressure is removed. This foam inner shell is covered for hygienic reasons and ease of care and includes a chin strap to offer control and stabilization. The inner helmet may be designed and sized to directly correspond to the user's head size. Between the foam inner helmet and the hard outer helmet will be attached a thin membrane of plastic, or microshield, to allow the inner helmet to rotate within the outer helmet, and to flex and extend to normal range of motion within the membrane. This membrane will be affixed directly to the foam and will minimize friction between the two parts of the helmet, thus allowing the head to move within the outer shell. The inner padding between the outer shell and the membrane will cushion the two areas and absorb noise and shock. The potential for concussion is dramatically reduced through incorporation of the inner helmet and micro shell when used in combination with the outer shell with attached padding strips.

The outer helmet will be similar in shape to the present football headgear, with the following modifications. First, the face opening is higher and wider, extending to the top of the forehead. The sides and back extend down to allow for easy attachment to and removal from the upper torso section. The face mask is attached by flexible strapping to the helmet, and this strapping is composed of a material that can be readily cut so as to allow for the rapid removal of the mask in emergency situations. The mask will generally follow the outer contours of the helmet and cover the entire face opening.

The connection of the helmet to the upper torso section is configured of opposite shelves that abut one another, thus offering resistance to axial loading by preventing further compression or distortion in the axial direction. This design also protects against medial and lateral impacts, to prevent distortion within the helmet. This design also protects against undue amounts of pressure in the helmet resulting from impacts to the anterior or posterior regions of either the helmet or the body shield.

The connection of helmet and upper torso section is strengthened by the use of three positive locking devices to ensure the connection during use. These three keyed lock points include one posterior lock located at the rear of helmet and one lock point by each ear area. The posterior lock would be the first point connected by the user when donning the helmet. The connection is simple, in that the user first inserts the lock point at the rear of the helmet, and swings the helmet over the head in an arc from behind the head, thus bringing the helmet over the head to the remaining two lock points. The connection of these three lock points automatically locks the rear part to the shell of body armor as well as the two points located near the ear area. This also prevents the outer helmet from rotating with respect to the rest of the unit.

The upper torso section of the present invention comprises a semi-rigid shell with sufficient padding to withstand violent impacts and to assist in the distribution of forces throughout the wearer's back and upper chest. This torso section is also provided with arm openings which are shaped to allow sufficiently free movement of the wearer's arms and shoulders. The shoulder area of the torso section includes a hemispherically-shaped shoulder guard which provides a protective shell for the shoulder while still allowing a wide range of motion. This shoulder guard includes a padded interior surface and is attached to the torso section by means of a wide flexible strap at the edge of the top of the shoulder section closest to the edge of the wearer's shoulder. A further curved shoulder protection plate is provided which is attached over the torso section and above-described guard at the juncture thereof, to provide further protection to the wearer's shoulder. This curved plate is also attached to the upper torso section by means of a flexible strap.

The upper torso section is open on either side, with the opening extending from the arm openings down the entire side of the section. This design facilitates the donning of the entire unit, and the front and back of the torso section are secured to one another by a set of flexible straps.

Attached to and extending out from the upper torso section is a cloth-encased system of padding that will serve as a means of transferring and softening impact to the musculature of the chest and back. This padding may extend down as far as the waist to provide additional protection to the wearer's rib cage, lower back and abdomen as may be desired by the participant. It may also be secured by strapping at the sides if desired.

The upper torso section extends around the neck area in such a manner so as not to constrict movement of the shoulder areas where the padding will ultimately be attached. This will prevent any contact on top of the shoulders, thus eliminating the possibility of direct contact with the wearer's clavicle area or proximal scapula. These connections are formed so as not to interfere with any shoulder joint function (glenohumeral joint). The shell will fit snugly on the wearer's posterior scapula (back) and chest (pectoralis) area.

The equipment may be further modified to include a bullet-proof vest, filters and gaskets to allow the wearer to perform in a gas or smoke environment, and a clear protective mask to shield the face from debris and gases, if sealed to the helmet with gaskets.

Further benefits and embodiments of this invention will be obvious upon review of the drawings and descriptions thereof.

DETAILED DESCRIPTION OF THE DRAWINGS

Figure 1:
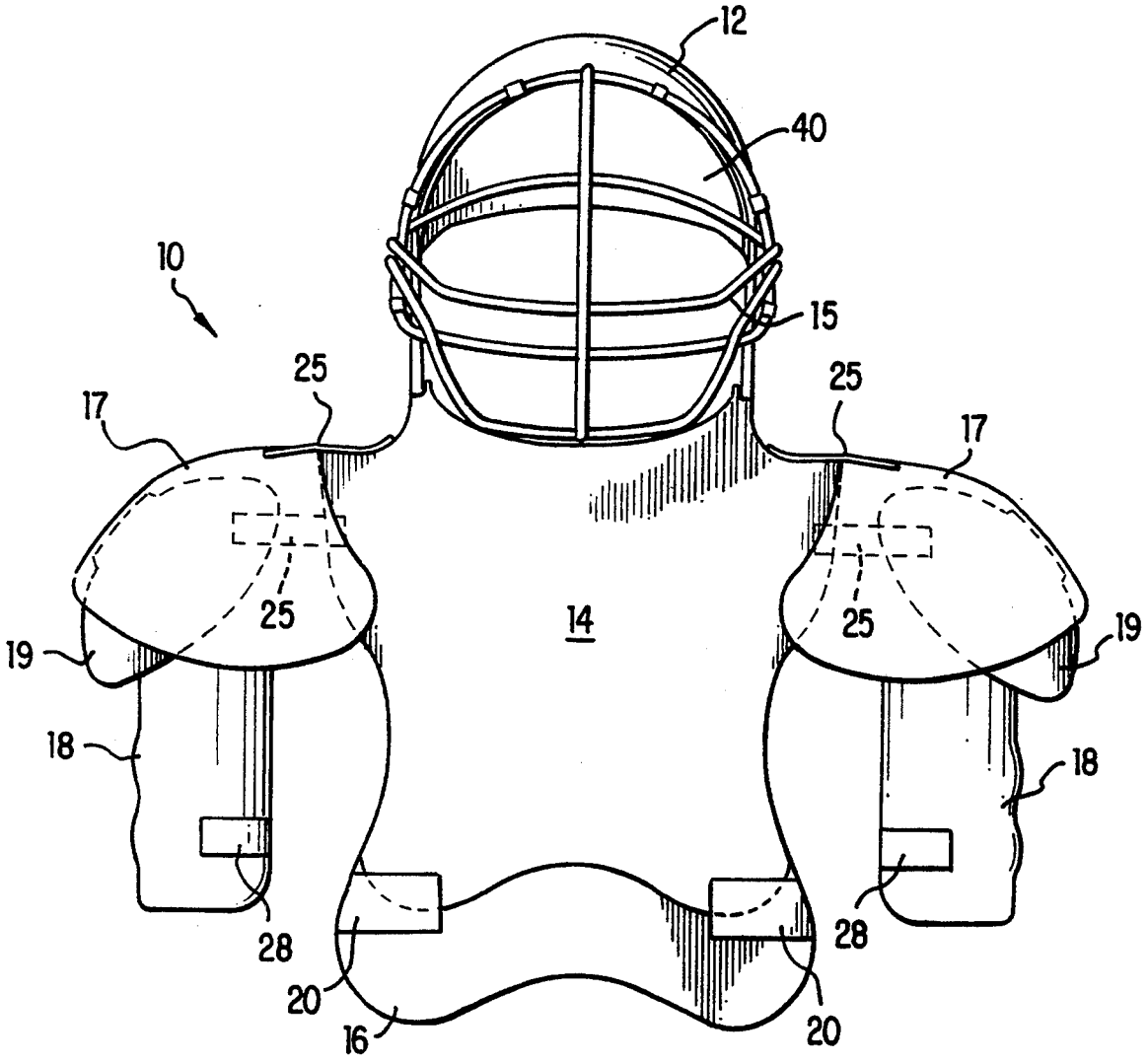
FIG. 1 is a front view of the combination helmet and body protection unit in accordance with the present invention.
Figure 2:
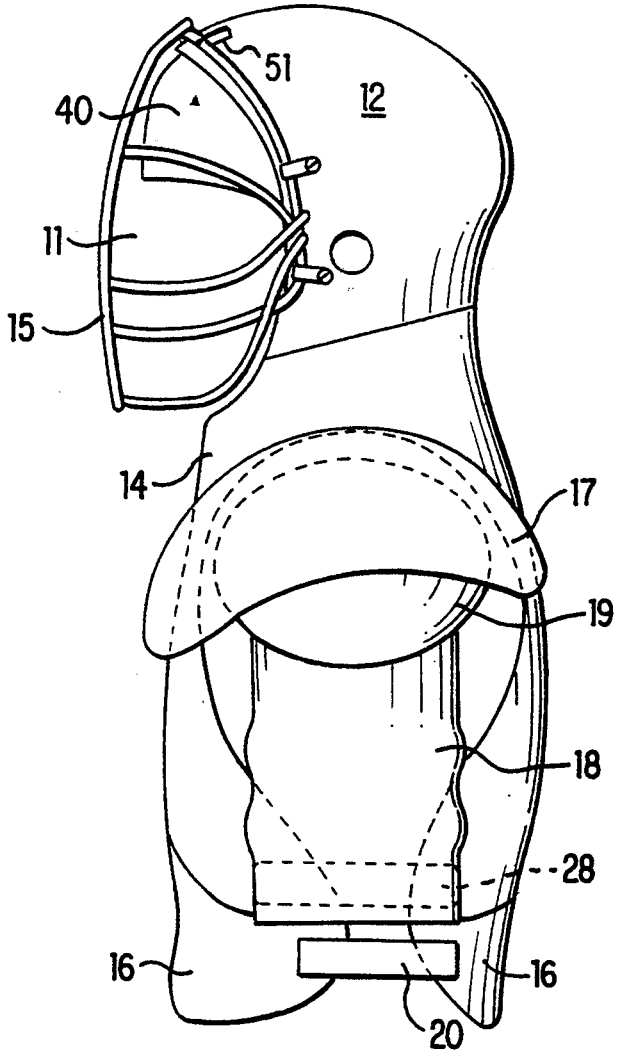
FIG. 2 is a side view of the combination helmet and body protection unit in accordance with the present invention.
Figure 3:
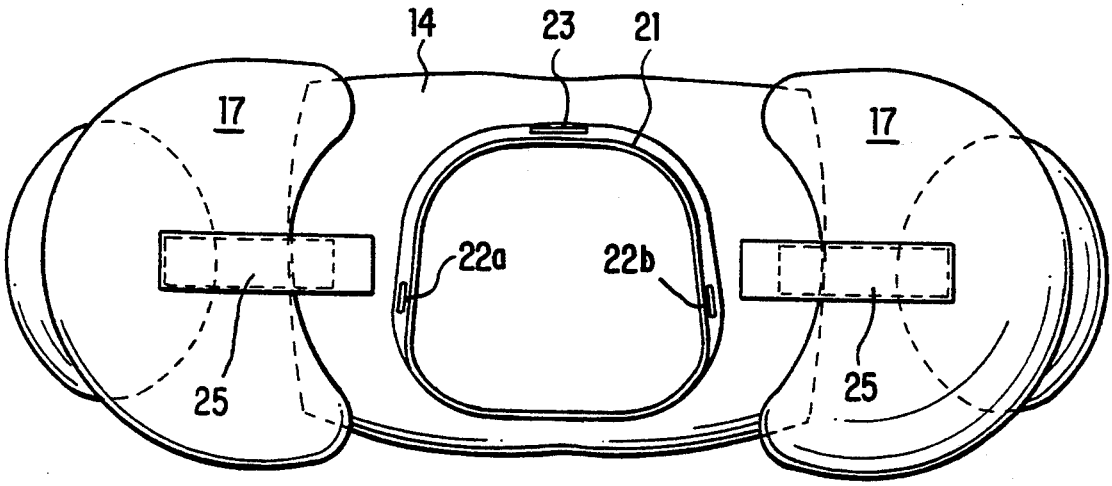
FIG. 3 is a top view of the body protection unit in accordance with the present invention without the helmet attached thereto.
Figure 4:
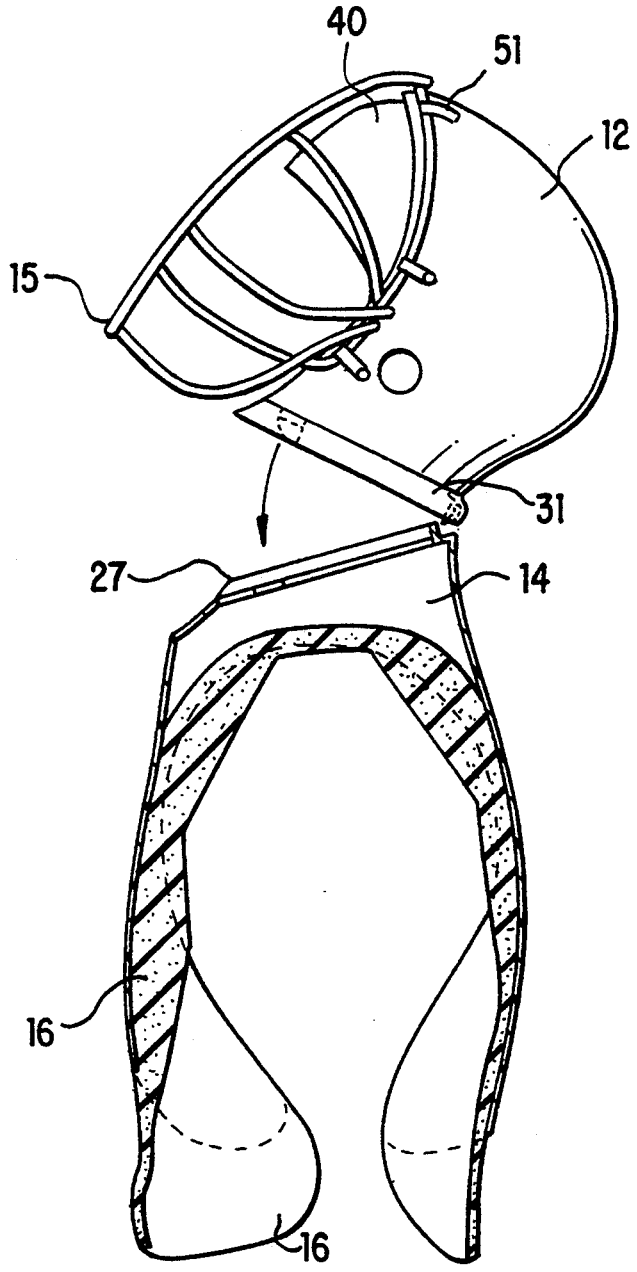
FIG. 4 is a partial cross-sectional side view of the body protection unit and the helmet.

FIG. 1 is a front view of body protection unit 10 comprised of helmet 12, upper torso unit 14 and lower torso unit 16, while FIG. 2 is a side view of the same elements. Helmet 12 includes face mask 15 which is securely attached thereto. Upper torso unit 14 includes two means for protecting the wearer's shoulder, including upper shoulder shield 17 and shoulder guard 19. Also shown is upper arm pad 18, which may be securely attached to shoulder guard 19 on both sides to afford protection to the upper arm of the wearer without limiting his mobility. This upper armpad includes an arm strap 28 which extends entirely around the wearer's arm to securely mount the arm pad 18 and to prevent unwanted movement thereof. All of these shoulder and arm protection elements may be connected to the upper torso unit 14 through the use of standard rivets and straps 25, which may be made of webbing of, e.g., dacron and/or leather.

As shown particularly in FIG. 2, the upper torso unit 14 and lower torso unit 16 comprises a one-piece unit having a front and back portion, with an opening therebetween to enable the wearer to easily put on or remove the unit. A plurality of flexible, adjustable straps 20 connect the front and back portions of these two units to secure the entire unit on the wearer.

As shown in FIGS. 1 and 2, the helmet is similar to helmets currently in American football with some significant exceptions. First, the face opening 11 is much larger than current standard helmets to give the wearer a wider range of peripheral vision. Second, the face mask 15 extends up higher to provide full protection to the head and face, and it is secured by means of strong, flexible straps 51, which are preferably made out of rubber/plastic type of material or leather, which can be readily cut to facilitate removal of the face mask 15 in an emergency.

Figure 9:
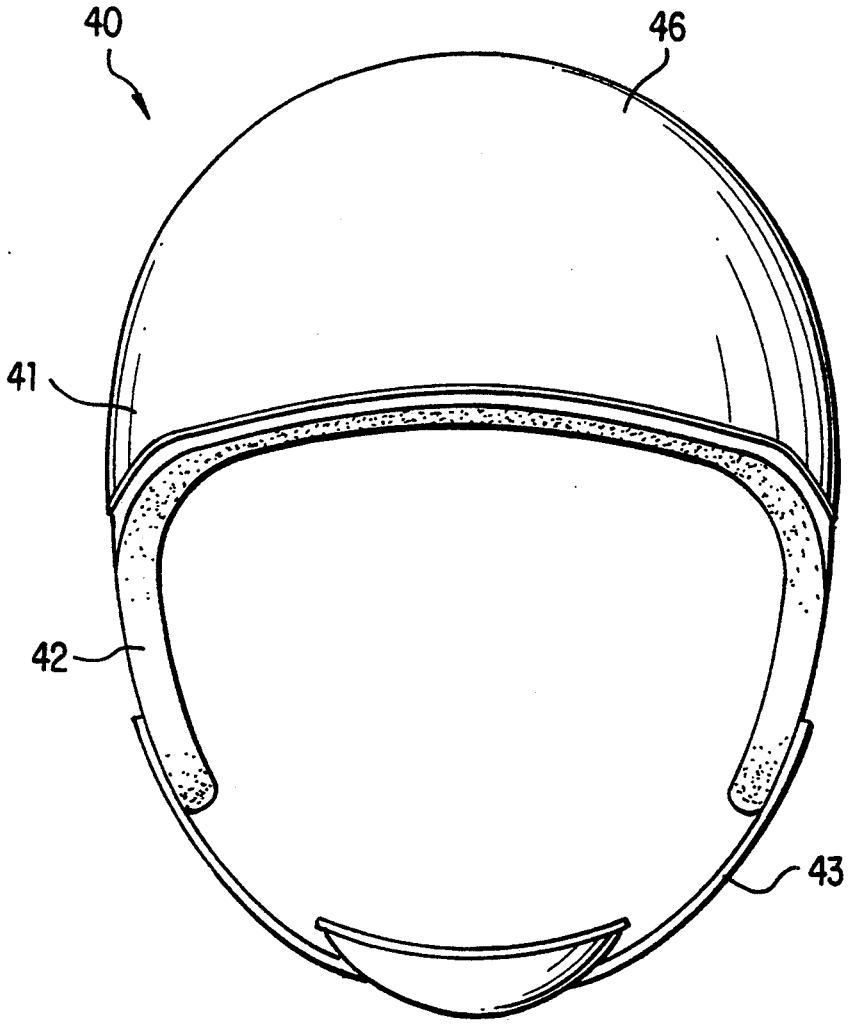
FIG. 9 is a front view of the inner helmet liner in accordance with the present invention.
Figure 10:
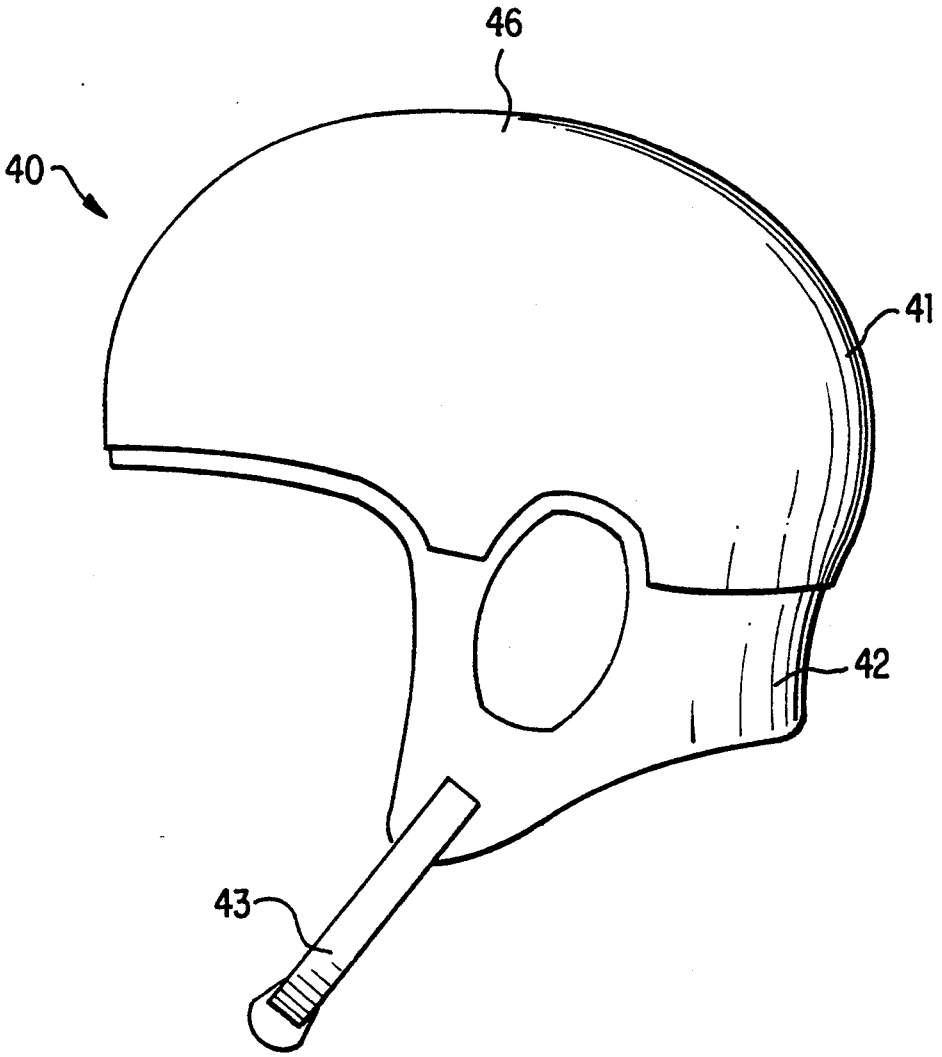
FIG. 10 is a side view of the inner helmet liner in accordance with the present invention.
Figure 12:
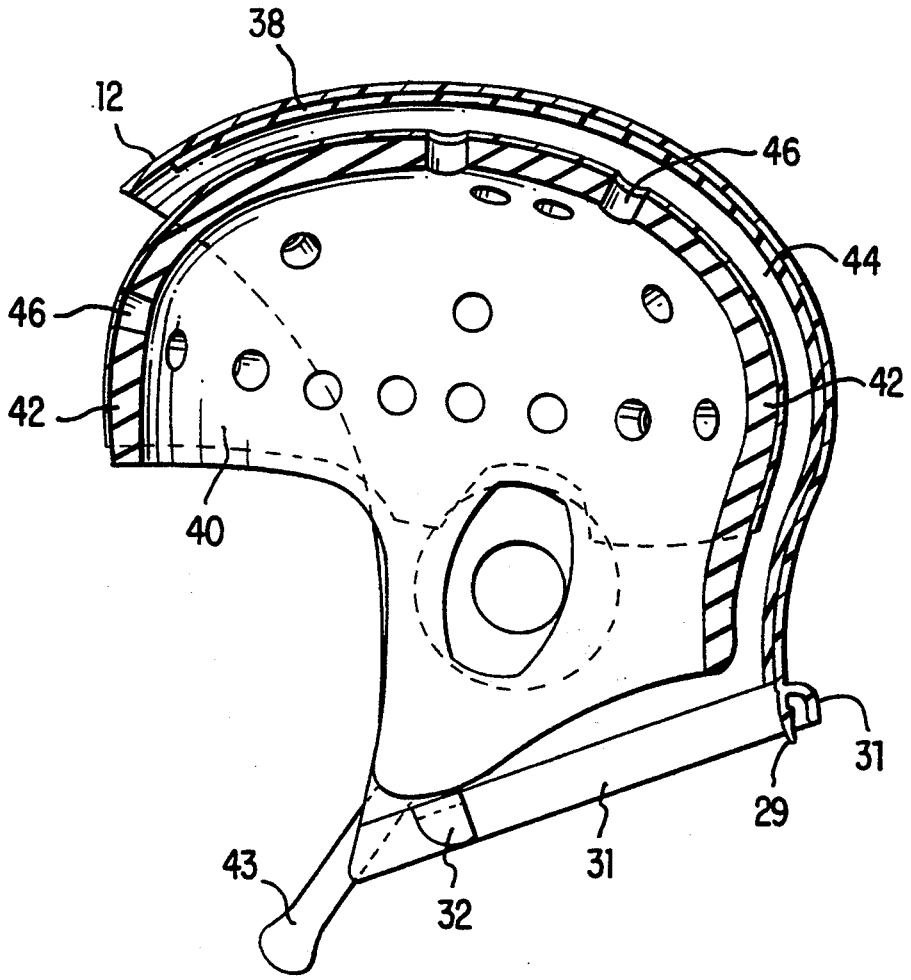
FIG. 12 is a cross-sectional side view of the outer helmet and the inner helmet combination in accordance with the present invention.

Third, the helmet incorporates a separate inner helmet section 40 which fits securely on the wearer's head and includes pads or bladders 42 to absorb much of the shock from direct blows to the head. The general shape of inner helmet 40 is shown in FIGS. 9 and 10, while FIG. 12 shows the placement of inner helmet 40 in outer helmet 12. Inner helmet 40 is covered by a plastic surface or microshield 41 to facilitate movement of the head in the helmet. This lining surrounds inner pads 42, and incorporates chin strap 43, which functions to hold the inner helmet 40 in place relative to the wearer's head. As shown in FIG. 12, there is an air space 44 between microshield 41 and the inside of outer helmet 12 of adequate room to facilitate mobility and protection. Air space 44 is exaggerated in FIG. 12. Inner helmet 40 also incorporates a plurality of air/compression holes 46 to facilitate air circulation, protection and material expansion.

The connection of the helmet to the body protection unit is critical to the operation of this unit. As shown in FIG. 3, 4, 6 and 8, upper torso unit 14 includes a generally flat collar surface 21 having a top or external surface and a bottom or internal surface, and having two side collar openings **22*a* and 22*b* and rear collar opening 23. Upper torso section 14 has a lip 27, while helmet has a corresponding lip 31 shaped so as to fit on lip 27**.

Figure 6:
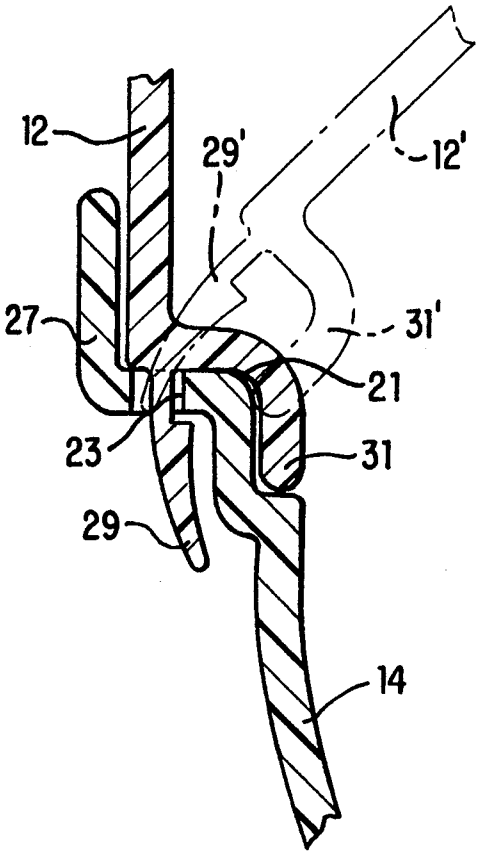
FIG. 6 is a cross-sectional side view of the helmet-body protection unit connection along the line A—A in FIG. 5.
Figure 5:
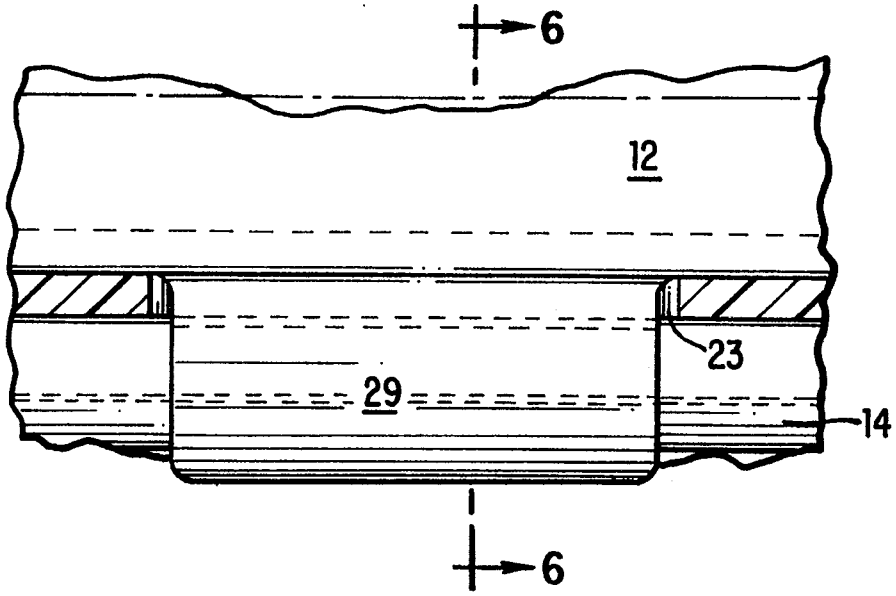
FIG. 5 is a detail view of the connection of the helmet to the body protection unit at the inside rear of the helmet.

FIGS. 5 and 6 show the connection of the rear of helmet 12 to the upper torso unit 14, including rear tab 29, which is inserted into rear collar opening at an angle as shown by reference numeral 12' and 29'. After helmet is moved into its standard position, tab 29 acts to lock the helmet in place through the interaction of notch 30 on the bottom surface of collar 21. This notch prevents the helmet from being moved vertically, and the rear tab 29 cannot be removed from rear collar opening 23 until it is moved to the position shown as 29' in FIGS. 4 and 6.

Figure 8:
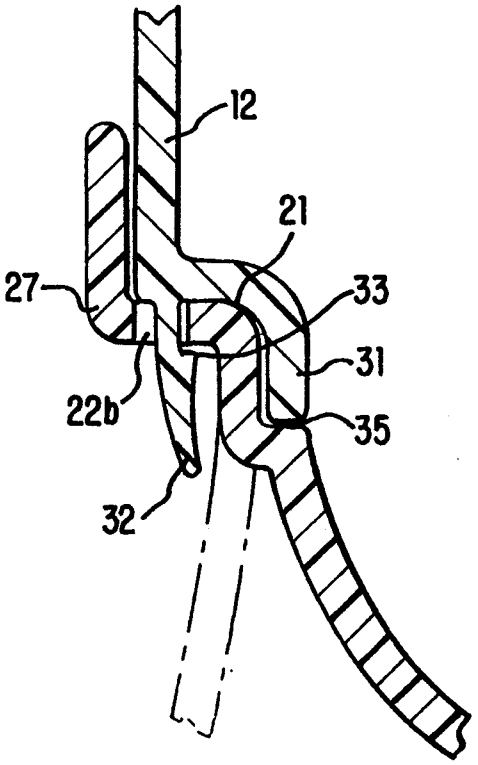
FIG. 8 is a cross-sectional side view of the helmet-body protection unit connection along the line B—B in FIG. 7.
Figure 7:
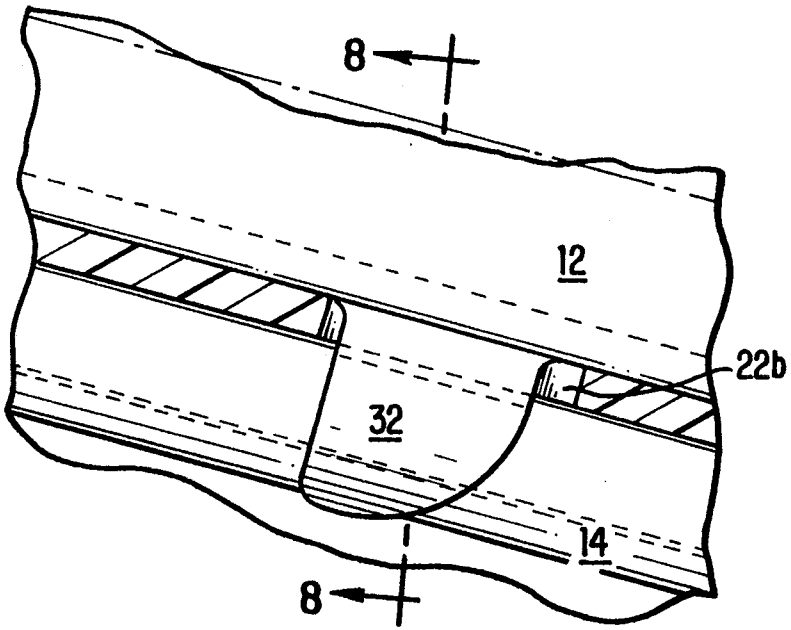
FIG. 7 is a detail view of the connection of the helmet to the body protection unit at the side of the helmet.

FIGS. 7 and 8 show the connection of the sides of the helmet 12 to upper torso unit 14. Specifically, helmet 12 includes at least two side tabs 32 which may be inserted into side collar openings **22*a* or 22*b*. After the rear connection described above is made, helmet is moved into proper position so that side tabs 32 can slide into side collar openings 22. The interaction of notch 33 and the bottom surface of collar 21 prevents the vertical movement of the helmet, and the interaction of tabs 32 and the sides of collar openings 22 also prevent rotation of the helmet. The helmet may be easily removed from the rest of the unit by the user inserting a finger or thumb on either side of his head to contact tabs 32 and to move them away from the upper torso unit so that notch 33 no longer is directly below the bottom surface of collar 21. This enables the user to apply an upward force to the helmet and remove it from the upper torso unit. Since the helmet is still connected at the rear thereof, it tends to swing in the proper angle to allow removal of rear tab 29 from rear collar opening 23** as described above. Thus, the entire removal operation can be easily performed in a matter of seconds.

Figure 11:
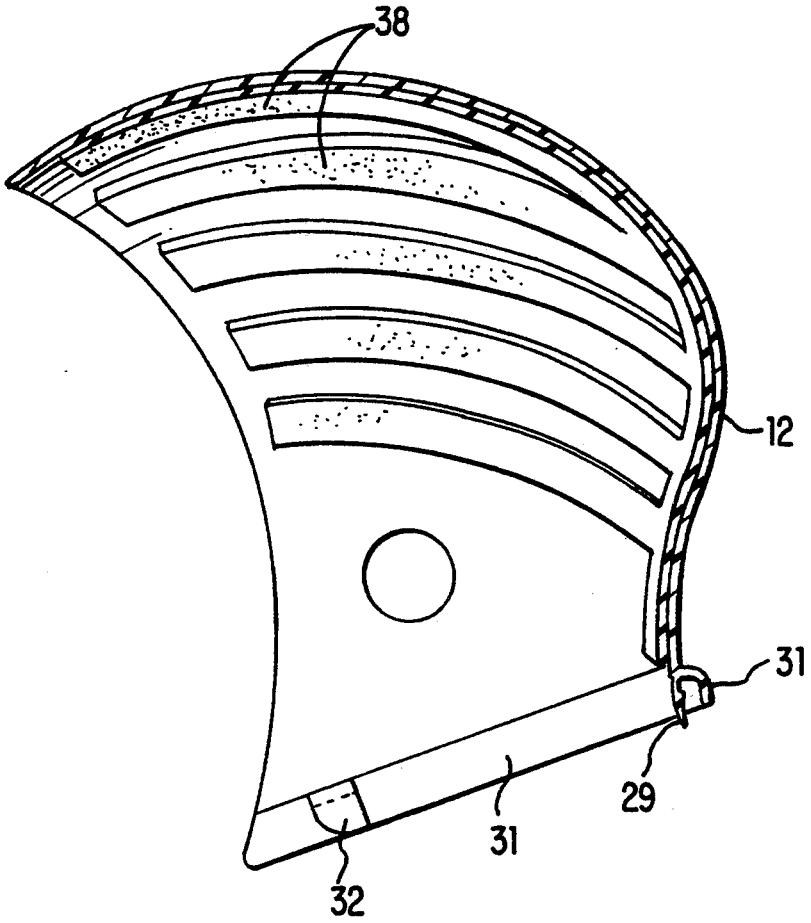
FIG. 11 is a cross-sectional side view of the outer helmet section in accordance with the present invention.

Outer helmet 12 also incorporates a plurality of pads 38 to cushion blows received to the wearer's head, and these pads may be formed out of materials generally known in the art for such padding. The pattern of such pads 38 is shown in FIG. 11.

As can be seen in FIG. 8, the upper torso unit includes a ledge 35 in addition to lip 27. Ledge 35 generally extends about the rear and sides of the unit and corresponds to lip 31 on helmet 12. When a large force is imposed on the top of helmet 12, the interaction of lip 31 on ledge 35 acts to disperse this force over the entire upper torso unit instead of allowing that force to be transferred solely through the wearer's neck, as is the case with prior equipment. The location of these elements with regard to the rest of the helmet is shown in FIGS. 11 and 12.

The rear tab 29 and side tabs 32 may be composed of the same material as helmet 12 and integrally formed therewith, or they may be formed from a different material such as metal and attached to the helmet through the use of rivets or other connection means which can provide sufficient strength to withstand the lateral and vertical forces applied to these elements. This latter embodiment is believed to provide the stronger connection.

The upper torso unit is preferably composed of a strong hard material such as Kevlar, ABS or polycarbonate, or a combination of all three. The preferred embodiment is made of ABS. Another unique feature of this invention is the incorporation of lower torso unit 16, which is made of a softer material, such as T-foam, Aliplaist or Pelite. Lower torso unit 16 acts to absorb much of the energy from blows to the lower regions and, if extended down far enough, can protect against blows to vital organs such as the kidneys.

We claim:

1. A body and head protection unit comprising a) an upper torso unit shaped to cover a wearer's chest, back and shoulder sections and supported primarily by the wearer's chest and back, and composed of an impact resistant material, said upper torso unit having an opening and for said wearer's neck, a generally flat surface extending around said neck opening, and a first lip extending upward from said flat surface, wherein said first lip and said flat surface are substantially coextensive;

b) an outer helmet composed of an impact resistant material and having an inner surface and an outer surface, said outer helmet having a face opening and an opening at the bottom thereof and a flat ledge formed substantially around the sides and back of said opening and a second lip extending down from said ledge;

c) an inner helmet securable to the wearer's head, and having an inner surface corresponding to the shape of a human head and an outer surface corresponding to the inner surface of said outer helmet such that when said inner helmet is located inside said outer helmet said wearer's head can move freely inside said outer helmet; and d) means for removably securing said outer helmet to said upper torso unit so that said outer helmet cannot move with respect to said upper torso unit, and said flat surface and said first lip of said upper torso unit are in contact with said ledge and said second lip of said outer helmet such that the forces applied to said outer helmet are transferred to said upper torso unit and to the chest and back of said wearer.

2. A body and head protection unit as set forth in claim 1, wherein said inner helmet further comprises a hard lining covering a portion of said outer surface of said inner helmet.

3. A body and head protection unit as set forth in claim 1, further comprising an inner torso padding unit securely attached to said upper torso unit.

4. A body and head protection unit as set forth in claim 1, further comprising a plurality of padding units for each shoulder of the wearer, each said padding unit comprising an upper pad securely attached to said upper torso unit and a lower shoulder cap attached to said upper pad.

5. A body and head protection unit as set forth in claim 1, wherein said upper torso unit is a single piece unit further including a front section and a back section separated at the bottom of said unit removably secured to one another at the bottom of said unit by means of flexible straps.

6. A body and head protection unit as set forth in claim 1, wherein said outer helmet is secured to said upper torso section to prevent rotation of said outer helmet relative to said upper torso section.

7. A body and head protection unit comprising a) an upper torso unit shaped to cover the upper body of the wearer and supported primarily by the wearer's chest and back and having an opening formed therein for the wearer's neck, said upper torso unit having an opening for said wearer's neck, a generally flat surface extending around said neck opening and a first lip extending upwards from said flat, wherein said first lip and said flat surface are substantially coextensive surface b) an outer helmet section having an inner surface and an outer surface composed of an impact resistant material, said outer helmet section having a face opening and an opening at the bottom thereof and a generally flat ledge formed substantially around the sides and back of said opening and a second lip extending down from said ledge;

c) an inner helmet section having an inner surface corresponding to the shape of a human head and an outer surface corresponding to the first inner surface of said outer helmet section, and means for securing said inner helmet section to the wearer's head to prevent movement of said inner helmet with respect to the wearer's head;

d) a shell mounted on said outer surface of said inner helmet section, said inner helmet section being mountable inside said outer helmet section so that said inner helmet section can move freely inside said outer helmet section; and e) means for removably securing said outer helmet to said upper torso unit so that said outer helmet cannot move with respect to said upper torso unit and said flat surface and said first lip of said upper torso unit are in contact with said ledge and said second lip of said outer helmet section such that the forces applied to said outer helmet section are transferred to said upper torso unit and to the chest and back of said wearer.

8. A body and head protection unit as set forth in claim 7, further comprising an inner torso padding unit securely attached to said upper torso unit.

9. A body and head protection unit as set forth in claim 7, further comprising a plurality of padding units for each shoulder of the wearer, each said padding unit comprising an upper pad securely attached to said upper torso unit and a lower shoulder cap attached to said upper pad.

10. A body and head protection unit as set forth in claim 7, wherein said upper torso unit is a single piece unit further including a front section and a back section separated at the bottom of said unit and removably secured to one another at the bottom of said unit.

* * * * *

UNITED STATES PATENT AND TRADEMARK OFFICE

CERTIFICATE OF CORRECTION

PATENT NO. : 5,353,437
DATED : October 11, 1994
INVENTOR(S) : Field & Caldwell

It is certified that error appears in the above-indentified patent and that said Letters Patent is hereby corrected as shown below:

Column 8, line 10, "flat," should read --flat surface--.

Column 8, line 12, after "coextensive" remove "surface" and insert --,--.

Signed and Sealed this

Seventeenth Day of January, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,353,437
DATED : October 11, 1994
INVENTOR(S) : Field & Caldwell

It is certified that error appears in the above-indentified patent and that said Letters Patent is hereby corrected as shown below:

Column 8, line 10, after "flat" insert --surface--

Column 8, line 12, after "coextensive" remove "surface" and insert --;--.

This certificate supersedes Certificate of Correction issued January 17, 1995.

Signed and Sealed this

Thirty-first Day of January, 1995

*Attest:*

*Attesting Officer*

BRUCE LEHMAN

*Commissioner of Patents and Trademarks*